US006932725B2

(12) United States Patent
Monsen

(10) Patent No.: US 6,932,725 B2
(45) Date of Patent: Aug. 23, 2005

(54) COLLAPSIBLE BACKBOARD SUPPORT ASSEMBLY FOR A BASKETBALL GOAL SYSTEM

(75) Inventor: Charles Monsen, Syracuse, UT (US)

(73) Assignee: Lifetime Products,, Clearfield, UT (US)

( * ) Notice: Subject to any disclaimer, the term of this patent is extended or adjusted under 35 U.S.C. 154(b) by 4 days.

(21) Appl. No.: 10/412,554

(22) Filed: Apr. 11, 2003

(65) Prior Publication Data

US 2004/0018900 A1 Jan. 29, 2004

Related U.S. Application Data

(60) Provisional application No. 60/372,343, filed on Apr. 11, 2002.

(51) Int. Cl.[7] ..... A63B 63/08

(52) U.S. Cl. ..... 473/484; 473/483; 473/481; 248/283.1; 248/280.11

(58) Field of Search ..... 473/484, 483, 473/482, 481, 476; 248/280.11, 283.1; D21/702, 703, 701

(56) References Cited

U.S. PATENT DOCUMENTS

| | | | | |
|---|---|---|---|---|
| 1,846,607 A | * | 2/1932 | Eldridge | 108/36 |
| 1,924,811 A | | 8/1933 | Schulz | |
| 2,313,188 A | | 3/1943 | Woodburn | |
| 3,427,025 A | | 2/1969 | Procter | |
| 3,586,324 A | | 6/1971 | Bearson | |
| 3,716,234 A | * | 2/1973 | Lancellotti | 473/481 |
| 3,765,676 A | | 10/1973 | Bearson et al. | |
| 3,802,702 A | | 4/1974 | Pulley | |
| 4,395,040 A | | 7/1983 | White | |
| 4,430,130 A | | 2/1984 | Sorensen | |
| 4,438,923 A | | 3/1984 | Engle et al. | |
| 4,781,375 A | | 11/1988 | Nye | |
| 4,801,142 A | | 1/1989 | Friesen | |
| 4,805,904 A | | 2/1989 | Nye | |
| 4,881,734 A | | 11/1989 | Nye | |
| 5,133,547 A | | 7/1992 | Pardi | |
| 5,211,393 A | | 5/1993 | Rolffs et al. | |
| 5,259,612 A | * | 11/1993 | Matherne et al. | 473/484 |
| 5,292,118 A | | 3/1994 | Allen et al. | |
| 5,324,027 A | | 6/1994 | Nye | |
| D350,797 S | | 9/1994 | Curtis | |

(Continued)

FOREIGN PATENT DOCUMENTS

| | | |
|---|---|---|
| EP | 908055 | 10/1957 |

*Primary Examiner*—Gregory Vidovich
*Assistant Examiner*—M. Chambers
(74) *Attorney, Agent, or Firm*—Workman Nydegger

(57) ABSTRACT

A deformable basketball goal support structure configured to selectively engage a rigid upright member and allow for adjustment of the height of a basketball goal above a playing surface. The basketball goal support structure has a backboard and an attachment member configured to selectively connect the goal support structure to the upright member. At least one support arm pivotally attaches between the attachment member and the backboard. Preferably, a pair of first support arms and a pair of second support arms pivotally attach between the attachment member and the backboard. The backboard includes a support frame having an internal periphery sufficient for receiving at least a portion of the attachment member and the support arms. The attachment member and the support arms, in combination, form a deformable parallelogrammic structure positionable between an extended position for game play and a collapsed position wherein at least a portion of the attachment member and the support arms are positioned within the internal periphery of the backboard and lie substantially flat against the backboard. The attachment member and the support arms may be generally disposed in the same plane as the backboard thereby forming a compact system when packaging or storing the basketball goal support structure.

50 Claims, 4 Drawing Sheets

U.S. PATENT DOCUMENTS 5,354,049 A * 10/1994 Matherne et al. ..... 473/484
5,357,872 A * 10/1994 Wilmore ..... 108/35
5,375,835 A 12/1994 Van Nimwegen et al.
5,390,914 A 2/1995 Schroeder
5,465,957 A 11/1995 Schroeder
5,478,068 A 12/1995 Schroeder
5,484,127 A 1/1996 Mower et al.
5,573,237 A 11/1996 Van Nimwegen et al.
5,695,417 A 12/1997 Winter et al.
5,720,679 A 2/1998 Schroeder
5,738,601 A 4/1998 Hughes
5,836,838 A 11/1998 Van Nimwegen et al.
5,879,247 A 3/1999 Winter et al.
5,919,102 A * 7/1999 Smith et al. ..... 473/484
5,947,847 A * 9/1999 van Nimwegen et al. .. 473/481
5,983,602 A 11/1999 Allen et al.
6,135,901 A 10/2000 Van Nimwegen
6,142,891 A 11/2000 Winter et al.
6,155,938 A 12/2000 Mower
6,179,733 B1 1/2001 Story

* cited by examiner

COLLAPSIBLE BACKBOARD SUPPORT ASSEMBLY FOR A BASKETBALL GOAL SYSTEM

CROSS-REFERENCE TO RELATED APPLICATIONS

This patent application claims priority to and the benefit of U.S. Provisional Patent Application Ser. No. 60/372,343, entitled Collapsible Backboard Support Assembly for a Basketball Goal System, filed on Apr. 11, 2002, which is hereby incorporated by reference in its entirety.

BACKGROUND OF THE INVENTION

1. The Field of the Invention

The present invention relates to a collapsible basketball goal support structure.

2. The Relevant Technology

Basketball is one of the most popular recreational sports among people of all ages. Most cities and counties sponsor recreational and instructional leagues where players as young as five and six years old can play. The days when basketball was confined to the gymnasium or schoolyard have long since passed. Today, the game of basketball is played anywhere there is a generally flat playing surface and a place to mount a backboard and rim.

More and more people are mounting basketball goals on their property. Many homes mount a basketball goal system on the garage or on a pole. Typically, these systems are located near a driveway or patio. However, an increasing number of houses have an outdoor concrete or asphalt pad dedicated solely for use as a basketball or sport court, and some homes include an indoor basketball court. Furthermore, those skilled in the art have developed portable basketball goal systems that can be moved from one playing surface to another, or even to an alternative location for storage.

Because basketball is usually played by people of all ages and abilities, many basketball systems have been developed with an adjustable basketball goal support structure. These adjustable goal support structures allow people of all ages and sizes to enjoy the sport of basketball because the basketball goal can be positioned at a height lower than the standard height of ten feet. Similarly, the adjustability of basketball goals has been especially beneficial to children. Many younger children simply do not have the strength necessary to shoot and make a basket at the standard height of ten feet. Other children have had to heave or hurl the basketball at the higher goal in order to attempt making a basket and, in so doing, typically develop improper shooting skills. Additionally, basketball goal support structures that are not height-adjustable sometimes frustrate children and cause them to lose their confidence because the goals are simply too high for them to consistently make a basket. This frustration sometimes causes children to ultimately give up the game and look for some other activity.

With the increasing popularity of basketball has come an increased demand for basketball equipment such as decorative backboards, support poles, nets, balls and complete basketball goal systems. Many retail outlets, department stores and discount stores sell complete basketball goal systems that are made by different manufacturers. Because of the number of competitors in the market, a manufacturer of basketball equipment is motivated to produce equipment that is of high quality, but sells at a competitive price. One significant factor contributing to the retail success and underlying consumer cost of a product is the amount of material required to package the product for delivery to the retailer or consumer. When a product requires a large amount of packaging material, the price of the product will proportionately increase and be passed on to the consumer.

Likewise the space required to ship and store a packaged product generally influences the ultimate cost to the consumer. If more space is required for storage, fewer units of the product can be shipped in a shipping container, thereby raising the per unit shipping cost. Thus, the price of the product may be increased when the product is packaged inefficiently.

Moreover, retail stores have a finite amount of floor or shelf space. For example, when a packaged product is large and bulky, the store may not be able to stock a large number of the product. Because the store can only stock fewer products as a result of its packaging bulk, the store may quickly deplete its inventory and thereby reduce the number of units sold. Moreover, a retailer may choose to stock a less bulky item in order to make the best use of its available space from a cost perspective.

A problem with most conventional basketball goal systems is that they do not lend themselves to efficient packaging. If a basketball goal system is shipped in a partially preassembled condition, one or more large, bulky boxes are usually needed. Moreover, because basketball goal systems have components that are generally irregularly shaped, a large amount of packaging materials such as cardboard, molded foam, foam pellets, shredded paper, and/or bubble sheets are needed to fill the various voids in the packaging container. This additional packing material may significantly add to the final cost of the product that is ultimately passed on to the consumer. Because prior art basketball goal systems are typically comprised of packaging that is bulky and somewhat cumbersome, only a limited number of units can be stored on retail outlet shelves or floors, which reduces the ultimate profitability of the basketball goal system.

To overcome the difficulty associated with shipping bulky basketball goal systems and goal support structures, many manufacturers tend to package the goal support structure of the basketball system in an unassembled state. The numerous pieces of an unassembled basketball goal support structure may be introduced into more compact packaging, requiring less bulky containers and a lesser amount of packaging material in an effort to reduce shipping cost and/or required storage space.

However, in addition to shipping costs and storage concerns, the success of a product in the retail market also depends on the ease of product assembly by the consumer. Thus, although some of the unassembled basketball goal support structures of the prior art may overcome many of the packaging, shipping and associated storage problems, additional difficulties may be created by shipping unassembled basketball goal support structures. For example, unassembled basketball goal support structures typically include many small component parts including, but not limited to, bolts, nuts, washers, fasteners and the like that can be easy to lose or misplace. These component parts may become lost during packaging, transit or after delivery to a consumer. The manufacturer may also fail to package all the necessary component parts with the basketball goal system, thereby permitting an inoperable system to be shipped and sold to a consumer.

Additionally, because the consumer may not be accustomed to assembling a complex basketball goal system, the multiple component parts of an unassembled goal support structure may be damaged during assembly, resulting in an inoperable or, more importantly, an unsafe basketball goal system. The assembly of prior art basketball goal support structures may also be difficult because some of the larger component parts, such as the backboard, the extending lever arms, the rim, etc., are typically heavy and not easily manipulated.

Furthermore, unassembled prior art basketball goal systems are often accompanied with a set of detailed assembly instructions. In many instances, these instructions are incomprehensible to the average consumer, causing the consumer to improperly assemble the basketball goal system, which may result in possible damage to the equipment and/or injury to one or more users. This is especially true in regards to the basketball goal support portion of the overall basketball goal system. Even with well-written instructions, the assembly of prior art unassembled goal support structures is generally labor intensive and time consuming. Special tools are also often required to assemble prior art goal support structures and, because many consumers do not have these tools, they must return to the store to buy them, or risk improperly assembling the basketball goal system. In this regard, it is of some marketing value to consumers for the manufacturer to be able to put "preassembled" or "partially preassembled" on the packaging material of the basketball goal system.

BRIEF SUMMARY OF THE INVENTION

It would be an advancement in the art to provide a basketball goal system with an essentially preassembled goal support structure that may be easily packaged in a compact configuration within a packaging container without the need for large amounts of packaging material.

It would be an additional advancement in the art to provide a basketball goal support structure that comes preassembled, thus not requiring any special tools for assembly. Furthermore, such a system would not require the consumer to keep track of multiple component parts.

It would be a further advancement in the art to provide a method of packaging a preassembled or partially assembled basketball goal support structure in a smaller, compact container. Preferably, such a container would be sized and configured for easy stacking.

One aspect of the collapsible basketball goal system described herein is a basketball goal system having a deformable basketball goal support structure that allows for the adjustment of the height of a basketball goal above a playing surface. The goal support structure can be manipulated between a collapsed position for packaging and storage, and an extended position for use in game play.

Yet another aspect of the collapsible basketball goal system is that the goal support structure may include an attachment member, such as a section of rigid support pole or the like. The attachment member may be configured to selectively connect the goal support structure to a rigid upright pole of a stationary basketball goal system, a rigid upright pole of a portable basketball goal system, a mounting bracket attached to a wall or other mounting structure and/or surfaces.

A first support arm may connect the attachment member to a backboard. The first support arm is attached between the backboard and the attachment member so that the first support arm may pivot relative to the backboard and the attachment member. A second support arm may also be pivotally attached between the attachment member and the backboard at a spaced apart distance from the first support arm. The attachment member, the first support arm, the second support arm and the backboard form a deformable parallelogrammic structure configured such that the attachment member may be positioned substantially flat against the backboard member when the goal support structure is disposed in the collapsed position. The attachment member would be positioned away from the backboard when the goal support structure is disposed in an extended position for game play.

Another aspect of the basketball goal system is the attachment member is preferably configured having a size sufficient to fit within a perimeter defined in the back section of the backboard when the basketball goal support structure is disposed in the collapsed position. Thus, the length of the attachment member may be slightly shorter than the dimensional height of the backboard. Additionally, the width of the attachment member is selected to be no wider than the dimensional width of the perimeter of the back section of the backboard. The first and second support arms may also be configured having a dimensional size sufficient to fit within the perimeter of the back section of the backboard when the basketball goal support structure is disposed in the collapsed position. In this regard, the length of each support arm may be no longer than the dimensional height and no wider than the dimensional width of the backboard In another aspect of the collapsible basketball goal system, the attachment member, the first support arm and the second support arm are pivotally connected to each other to allow the support arms and the attachment member to nest substantially flat against the back section of the backboard when the goal support structure is disposed in the collapsed position. In this configuration, the basketball goal support structure may be packaged in a compact and preassembled condition within a shipping container. Thus, the goal support structure of the present invention facilitates efficient and compact shipping, thereby reducing required floor space used by the retailer to stock the basketball goal system.

Another aspect is that a pair of first and second support arms may be attached between the attachment member and the backboard to provide increased stability therebetween. The attachment of the second set of support arms may be parallel to the first set of support arms and pivot and collapse in the same nesting manner as described above.

Yet another aspect of the basketball goal system is the backboard is desirably constructed from blow-molded plastic with a generally hollow interior portion. Significantly, this lightweight basketball backboard can be easily transported, which decreases shipping costs. The lightweight basketball backboard can also be easily moved and stored. Additionally, the lightweight basketball backboard allows a basketball goal system to be easily constructed and assembled. Further, because the basketball backboard is lightweight, it does not require a large support structure to support the backboard above the playing surface.

Another aspect of the basketball goal system is the backboard may include one or more depressions, "tack-offs" or "kiss-offs," formed in the frame. The depressions, which extend from one surface towards another surface, are desirably sized and configured to increase the strength and/or rigidity of the frame. Preferably, the depressions extend from one surface and contact or engage an opposing surface, but the depressions do not have to contact or engage the opposing surface. The depressions are desirably formed in the back or rear surface of the basketball backboard so that the depressions are generally not visible while playing the game of basketball. The depressions, however, may also be formed in the front surface or other surfaces of the basketball backboard. If the depressions are formed in the front surface of the backboard, these depressions may be covered in whole or in part by the backboard or rebound member. In addition, one or more depressions may be formed in the rear surface of the backboard and one or more depressions may be formed in the front surface of the backboard, and these opposing depressions may be generally aligned. At least a portion of these opposing depressions preferably contact or engage each other, but the opposing depressions are not required to touch or engage. Finally, a portion of the basketball backboard may include one or more depressions on one surface and one or more depressions in an opposing surface.

Advantageously, the blow-molded plastic basketball backboard is relatively strong because it preferably includes two or more opposing walls or surfaces that are separated by a given distance. The opposing walls help create a high-strength, rigid basketball backboard. Because the interior portion of the backboard between the opposing walls is generally hollow, that creates a lightweight backboard. Significantly, the strong and sturdy basketball backboard can withstand repeated impacts with a basketball or other similar objects. Further, the strong and rigid backboard allows a basketball system with good rebounding characteristics to be constructed.

Significantly, the basketball backboard can be quickly and easily constructed because it is preferably constructed using a blow-molded plastic process. Advantageously, the blow-molding process allows the double walls and any suitable number of depressions to be quickly and easily formed. As discussed above, the double walls and depressions allow a strong and sturdy backboard to be constructed. These and other features also allow the basketball backboard to be constructed with relatively thin plastic walls and that reduces the amount of materials used to construct the backboard. This saves manufacturing costs and reduces the amount of resources required to construct the backboard. The thin plastic walls also allow the backboard to be cooled more quickly during the manufacturing process, and that saves time and further decreases costs.

Yet another aspect of the basketball backboard is it can be constructed in any desired configuration, shape, size and design depending, for example, upon the intended use and/or configuration of the backboard. Significantly, if the basketball backboard is constructed from blow-molded plastic, it can easily be formed into any desired size, configuration, and color. Further, basketball backboards constructed from blow-molded plastic are durable, weather resistant and generally temperature insensitive. The blow-molded plastic basketball backboards, in contrast to conventional metal frames, do not corrode, rust or otherwise deteriorate over time.

Still another aspect of the collapsible basketball support structure is that, to further increase the strength and stability of the basketball goal support structure, the backboard may include a support frame. The support frame may present a cavity formed at the back section of the backboard, preferably during the blow-molding process. This cavity may be useful to provide a mechanism to nest or enclose the attachment member and the first and second support arms. When the basketball goal support structure is positioned in the collapsed position, the attachment member, the first support arm(s), and the second support arm(s), do not extend beyond the internal confines of the cavity. This configuration presents a compact basketball goal support structure that may be easily packaged in its preassembled state within a shipping container.

A further aspect is that the collapsible basketball goal support structure is part of an adjustable basketball goal system that may include a support base, an upright rigid pole operably disposed in relation to the support base, and an adjustment assembly that facilitates selective adjustments to the height of the basketball goal above a playing surface. The attachment member may be configured as a top portion of an upright rigid pole that is configured to selectively engage a corresponding lower portion of the upright rigid pole.

To accommodate an engagement between the goal support structure and an adjustment assembly, a receiving aperture may be formed in a distal end of one or more of the support arms for engagement to an extension arm. The extension arm may have a first end and a second opposing end, wherein the first end is configured to be pivotally attached to the receiving aperture of the support arms and the second opposing end is configured to be pivotally attached to the upright support pole of the basketball goal system. In this configuration, movement of the extension arm selectively deforms the parallelogrammic goal support structure, thus adjusting the height of the basketball goal relative to a playing surface.

Another aspect is the basketball goal system may include a locking mechanism operably disposed relative to the extension arm. In operation, the locking mechanism may be positioned between an engaged position and a disengaged position thereby facilitating an adjustment in length of the extension arm that corresponds to an adjustment to the height of the basketball goal of the goal support structure relative to the playing surface. A handle may be provided that assists a user in displacing the locking mechanism between the engaged position wherein the basketball goal support structure is restricted from deforming and the disengaged position wherein the goal support structure is freely deformable. The locking mechanism may include a locking key disposable within a plurality of receiving slots that selectively anchor the second end of the extension arm relative to a portion of the length of the rigid support pole.

Yet a further aspect of the basketball goal system is the method of packaging the preassembled, deformable basketball goal support structure. Preferably, the method may include the steps of positioning the basketball goal support structure in a collapsed position, whereby the attachment member and the first and second support arms are selectively positioned within the cavity formed in the back section of the backboard and inserting the collapsed basketball goal support structure into a relatively flat packaging container for shipping.

The attachment member may be configured to be positionable within a perimeter of the backboard when the basketball goal support structure is disposed in the collapsed position. In addition, the first support arm(s) and the second support arm(s) may be configured to be positionable within the perimeter of the backboard when the goal support structure is disposed in the collapsed position. Thus, a preferred method of packaging may include the additional steps of positioning the first support arm(s) and the second support arm(s) within the perimeter of the backboard adjacent at least a portion of the length of the attachment member. The preferred method of packaging the goal support structure may include the step of nesting the attachment member and the first and second support arms substantially flat against the backboard. The goal support structure may be further compacted by configuring the attachment member, the first support arm(s) and/or the second support arm(s) to lie in substantially the same plane when the goal support structure is disposed in the collapsed position. In such instances, a preferred method of packaging the goal support structure may include the additional step of positioning the attachment member and the first and second support arms in substantially the same plane as the backboard.

These and other features and advantages of the present invention will become more fully apparent from the following description and appended claims, or may be learned by the practice of the invention as set forth hereinafter.

BRIEF DESCRIPTION OF THE DRAWINGS

In order to readily understand the manner in which the above recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not, therefore, to be considered limiting of its scope, the invention will be described and explained with additional specificity and detail through the use of the accompanying drawings in which.

DETAILED DESCRIPTION OF THE PREFERRED EMBODIMENTS

The preferred embodiments of the present invention will be best understood by reference to the drawings, wherein like parts are designated by like numerals throughout. It will be readily understood that the components of the present invention, as generally described and illustrated in the Figures herein, could be arranged and designed in a wide variety of different configurations. Thus, the following more detailed description of the embodiments of the apparatus, system, and method of the present invention, as represented in FIGS. 1 through 4, is not intended to limit the scope of the invention, as claimed, but is merely representative of presently preferred embodiments of the invention.

Figure 1:
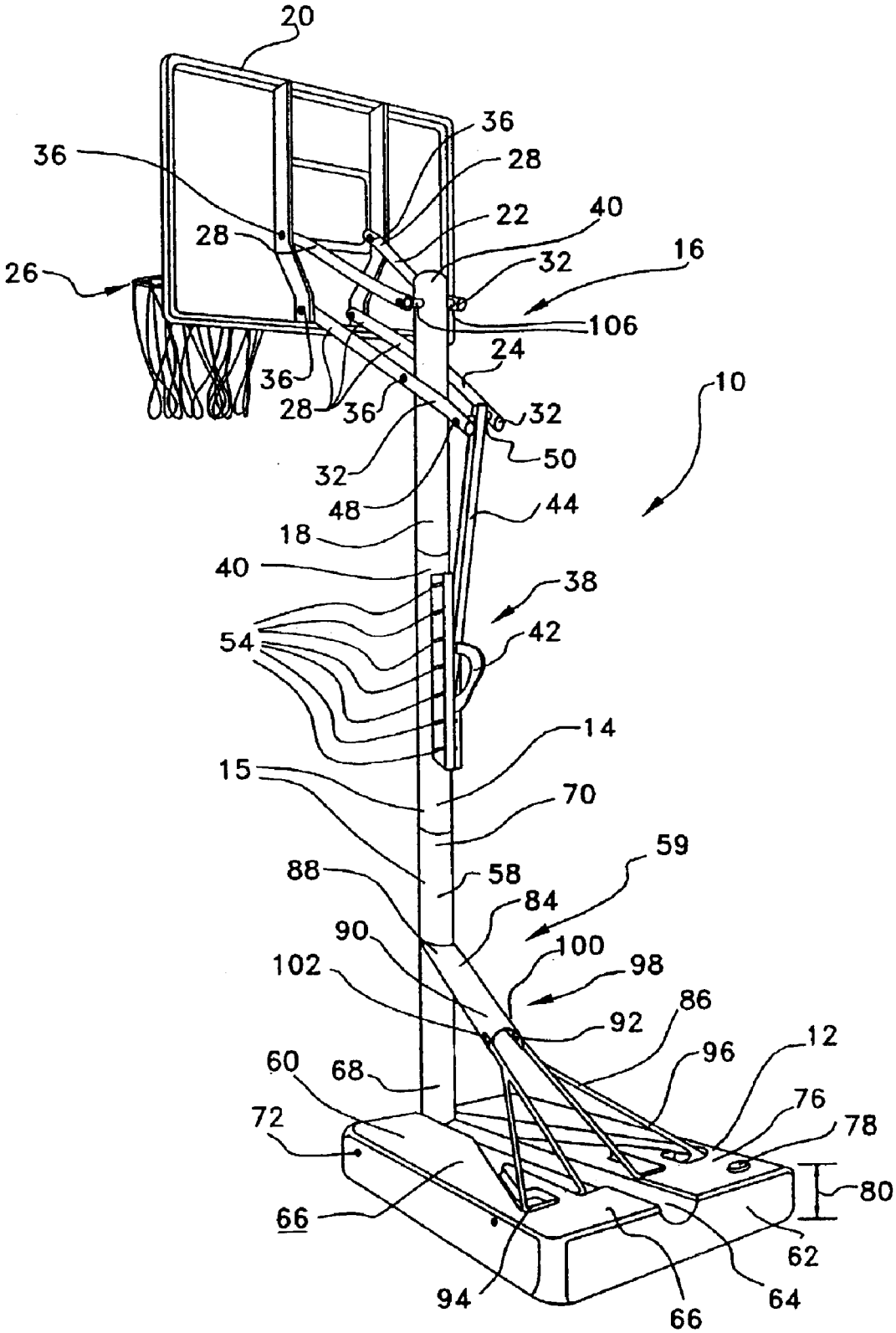
FIG. 1 is a perspective view of a basketball goal system showing a basketball goal support structure disposed in an extended position.

With reference to FIG. 1, a basketball goal system 10 according to the present invention is illustrated. The basketball goal system 10 includes a support base 12, a rigid upright member 14, a goal support structure 16 and a locking mechanism 38 disposed between the goal support structure 16 and the rigid upright member 14. The goal support structure 16 may include an attachment member 18, a backboard 20, a first support arm 22 and a second support arm 24. The goal support structure 16 preferably includes a first pair of support arms 22 and a second pair of support arms 24.

Figure 2:
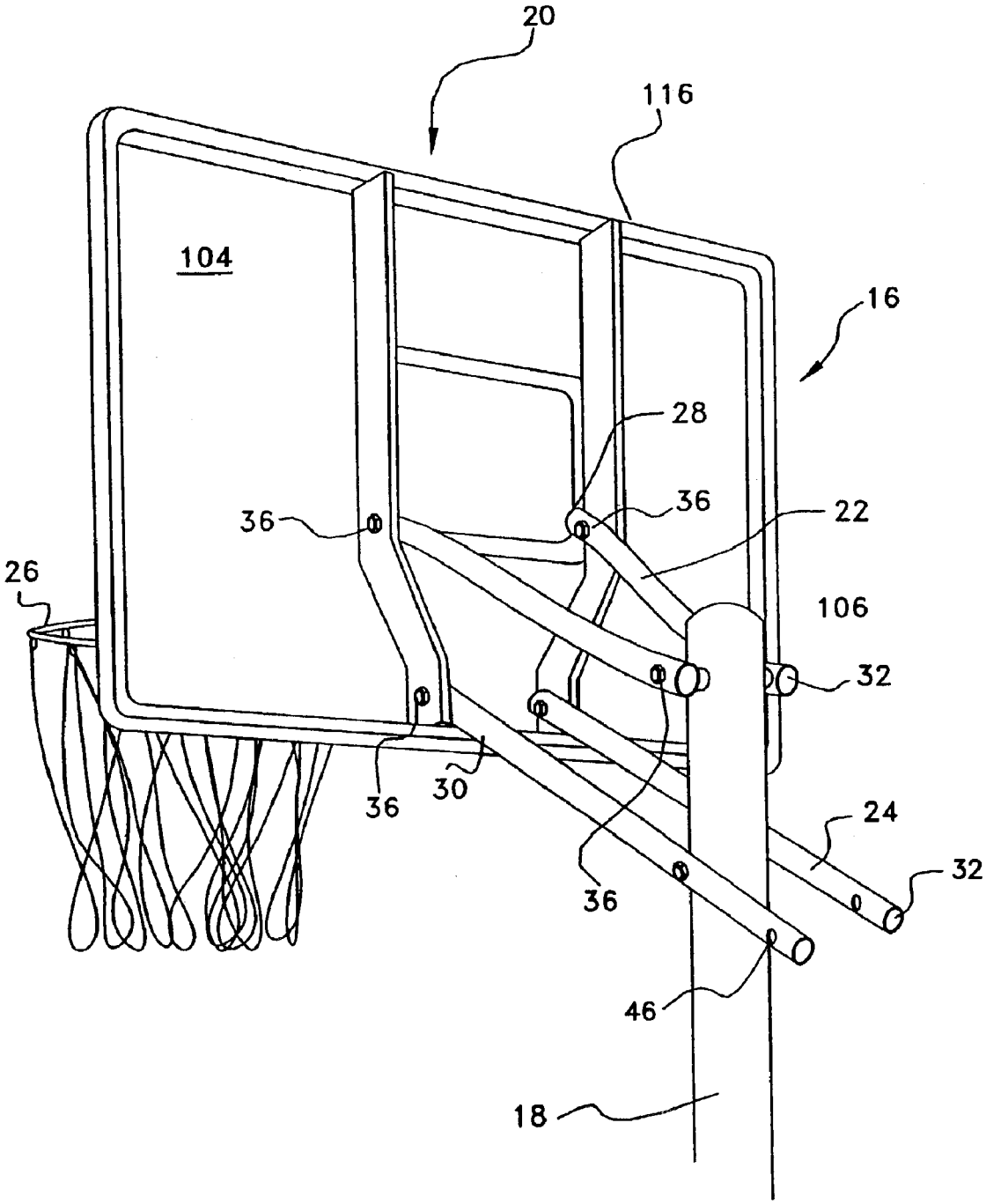
FIG. 2 is a close-up perspective view of the basketball goal support structure of FIG. 1.

A basketball goal 26, including a rim and net, may be attached to the backboard 20 by any one of a variety of conventional attachment mechanisms. The first support arms 22 and the second support arms 24 each have a first end 28 and a second opposing end 32. Each of the first ends 28 of the first and second support arms 22, 24 may be pivotally secured to the backboard 20 by fasteners 36. Similarly, each of the second opposing ends 32 of the first and second support arms 22, 24 may be pivotally secured to the attachment member 18 by fasteners 36. The fasteners 36 may be selected from a variety of suitable fasteners such as pins, bolts, rods, screws, rivets and the like. As best illustrated in FIGS. 1 and 2, the attachment member 18, the backboard 20, the first support arm 22, and the second support arm 24 preferably form a parallelogrammic structure, thereby permitting the basketball goal support structure 16 to be deformable relative to the upright rigid support pole 14.

The attachment member 18 of the goal support structure 16 is configured to attach to an upper end of the upright member 14 of the basketball goal system 10. Preferably, the upright support member 14 includes a rigid pole having an upper end configured to be press fit or friction fit to the attachment member 18. In particular, the attachment member 18 is preferably formed as an upper pole section with a lower end configured to fit over the upper end of the upright support member 14, thus forming a secure attachment. For example, the attachment member 18 maybe press fit into an upper end 40 of the pole member 14. Alternatively, the attachment member 18 may be attached to the upper end 40 of the pole member 14 by other suitable means known within the art such as a locking bolt, a brace, rivets, screws or the like. It will be appreciated by those of skill in the art that other attachment members 18 may be employed which include by way of example, and not limitation, brackets, braces and the like where the basketball goal support structure is attached to a surface (e.g., a wall or roof). Moreover, the configuration of the attachment member 18 may come in a variety of shapes and sizes depending on what the goal support structure is designed to be attached to.

To facilitate height adjustment of the goal support structure 16, the basketball goal system 10 may include an extension arm 44 disposed between the deformable goal support structure 16 and the upright support member 14 such that selective movement of the extension arm 44 correspondingly deforms the goal support structure 16.

An adjustment assembly 38 may be operably disposed relative to the extension arm 44. In operation, the adjustment assembly 38 may be positioned between an engaged position and a disengaged position thereby facilitating an adjustment in length of the extension arm 44 that corresponds to an adjustment to the height of the basketball goal 26 of the goal support structure 16 relative to a playing surface. A handle 42 may also be provided to assist a user in displacing the adjustment assembly 38 between the engaged position wherein the basketball goal support structure 16 is restricted from deforming and the disengaged position wherein the goal support structure 16 is freely deformable. The adjustment assembly 38 may include a locking key disposable within a plurality of receiving slots so as to selectively anchor the second end of the extension arm 44 relative to the rigid support pole 14. There are other suitable mechanisms or assemblies for locking the basketball goal support structure 16 at a particular height above a playing surface. These adjustment mechanisms or assemblies may include, by way of example and not limitation, a lockable piston assembly, a locking plate arrangement, a clutch or ratchet system, a friction/release system, a compression crank adjustment or other simple mechanical devices such as a bolt or a locking pin.

Preferably, the handle 42 is positioned at a height accessible to children of suitable ages to play basketball such that the basketball goal support structure 16 may be readily adjusted to a height equal to the shooting ability of the player(s). Consistent with the foregoing, the adjustment assembly of the basketball goal system 10 of the present invention can be used to facilitate deformation of the parallelogrammic goal support structure 16 into a variety of configurations corresponding to various heights of displacing the basketball goal 26 above a playing surface.

The extension arm 44 may be connected to the deformable parallelogrammic goal support structure 16 in a variety of ways. As best illustrated in FIGS. 1 and 2, a receiving aperture 46 may be formed proximate the second end 32 of one or more second support arms 24. A fastener 48 may be introduced through the receiving aperture 46 and secured to the extension arm 44. Spacers 50 may be provided to prevent sliding of the extension arm 44 along the length of the fastener 48. The extension arm 44 may also be configured having a sufficient width to be snugly secured upon the fastener 48 so that spacers 50 are not required. Moreover, the second ends 32 of the second support arms 24 may be formed having a bend in their length to reduce the space between the extension arm 44 and the second ends 32 of the support arms 24.

The receiving aperture 46, however, may be located in other locations relative to the goal support structure 16. For example, the receiving aperture 46 may be formed along the length of the first support arms 22 or on the backboard 20. Additionally, multiple receiving apertures 46 may be located in each of the first support arms 22 and the second support arms 24, if desired. In this configuration, the first support arms 22 and the second support arms 24 may extend substantially outward from the attachment member 18 to provide sufficient room for attachment of the extension arm 44 to both sets of support arms 22, 24.

The extension arm 44 may also include two substantially parallel bars (not shown). These substantially parallel bars would be pivotally attached between the upright support member 14 and the receiving apertures 46 of the basketball goal support structure 16 such that vertical displacement of the adjustment assembly 38 and the handle 42 may result in simultaneous displacement of the parallel bars and corresponding deformation of the goal support structure 16.

With reference still to FIG. 1, the support base 12 includes a proximal end 60 and a distal end 62. The support base 12 may be configured with a recess 64 on its upper exterior surface 66 which runs between the proximal end 60 and the distal end 62 of the base 12. The recess 64 is preferably configured such that a portion of the upright support member 14 may be positioned in a collapsed position and nest within the recess 64 of the support base 12 to thereby facilitate compact storage or packaging. The base 12 may preferably be a hollow ballast capable of receiving water or sand. The base 12 may also have other geometries to aid in shipping. For example, an opening in the bottom surface of the base 12 may be configured to receive a basketball goal for storage and shipping purposes (not shown).

A base end 68 of the upright support member 14 may be received into a front portion of the recess 64 formed near the proximal end 60 of the support base 12 and attached to the support base 12. The upright support member 14 is pivotally connected to the support base 12 adjacent the base end 68 of the upright support 14 by a pivot member 72. The pivot member 72 may be selected from a variety of suitable fasteners which allow the upright support 14 to pivot about an axis. Such suitable fasteners may include a pin, bolt, rod, axle, screw, rivet or the like.

In other variations of the basketball goal system 10, the support base 12 is portable. In order to facilitate movement of the support base 12 from one location to another, one or more wheels or wheel assemblies (not shown) may be provided. For example, a rotatable caster may be positioned adjacent the proximal end 60 of the support base 12 contiguous the base end 68 of the upright support member 14 which facilitates controlled directional movement of the basketball goal system 10. In addition, one or more wheels may be positioned adjacent the distal end 62 of the support base 12 in relation to mountable axles to assist in bearing the weight of the base upon movement. A caster assembly (not shown) may be positionable between an engaged position such that the caster supports the weight of the basketball goal system above the playing surface and a disengaged position such that a significant portion of the weight of the basketball goal system rests on the playing surface for game play. In other variations, one or more wheels may be mountably disposed in relation to either the proximal end 60 or the distal end 62 of the support base 12. By tilting the weight of the basketball goal system 10 about the end of the base 12 having the mounted wheels, the wheels contact the playing surface and therefore facilitate movement of the support base 12 from one location to another.

The support base 12 may be hollow for receiving a ballast weight such as sand or water. The introduction of a ballast material into an internal cavity formed within the support base 12 is necessary so that the support base 12 having a ballast material may support the weight of the basketball goal system 10 during rigorous game play, while allowing the support base 12 without the ballast material to be lighter in weight for shipping.

The base 12 may further preferably be constructed from blow molded plastic, and the recess 64 integrally formed in the base 12 during the blow molding process. The support base 12 may be configured with an opening 76 formed in an upper surface 66 of the base 12. The support base 12 should be configured with an internal periphery sufficient to allow for expansion of the ballast material. A cap 78 may be provided for sealing the opening 76 and thereby preventing displacement of the ballast material.

In other variations, the upright support member 14 may be pivotally disposed in relation to the support base 12 such that the upright member 14 may be pivoted about an axis between an extended or deployed position for game play and a collapsed position for storage. In the extended or deployed position, the upright support member 14 is generally directed upward and perpendicular to the upper surface 66 of the support base 12. In the collapsed position, the upright support member 14 is disposed in a generally horizontal position substantially parallel to the upper surface 66 of the support base 12. As noted above, when the upright support member 14 is disposed in the collapsed position, a portion of the upright member 14 is positionable within the recess 64 formed in the upper surface 66 of the support base 12.

The upright support member 14 further includes a support brace assembly 59 to secure the upright support 14 in the extended or deployed position and thereby restrict further pivoting of the upright support member 14 about the pivoting member 72. The support brace assembly 59 may include a sleeve 84 pivotally attached to at least a portion of the length of the upright support member 14 and a stand 86 pivotally attached to a portion of the upper surface 66 of the support base 12.

Like the attachment member 18, the upright support member 14 may be constructed in a variety of configurations and using a variety of substantially rigid materials. Preferably, the upright support member 14 includes at least one sectional member 15, and preferably two telescoping sectional members, formed of metal tubing and having an appropriate length. The upright support member 14 may be configured having a square, rectangular, triangular or other suitable geometrical shape sufficient to provide adequate structural integrity to support the basketball goal support structure 16 above a playing surface and relative to the support base 12. A round cross section may be desirable for the configuration of the upright support member 14 to prevent injury to a player who may forcibly contact the upright member 14 during rigorous game play. Alternatively, the upright support member 14 may be formed as a single piece.

The upright support member 14 may be constructed of any suitable rigid material such as, by way of example and not limitation, wood, fiberglass, ceramic, graphite, any of numerous organic synthetic or processed materials that are mostly thermoplastic or thermosetting polymers of high molecular weight with or without additives. Such thermoplastic or thermosetting resins may include plasticizers, auto oxidants, colorants, or fillers, which can be shaped, molded, cast, extruded, drawn, foamed or laminated into objects, films, or filament polymers or other suitable composite materials that are sufficient to support the basketball goal support structure 16 above a playing surface.

Because a basketball goal system is typically subjected to considerable force during game play, the support brace assembly 59 must be strong enough to retain the upright support member 14 in the extended or deployed position. To add to the strength of the support brace assembly 59, the sleeve 84 may be constructed from a solid piece formed in a desired configuration and the stand 86 may have one or more support legs 96. Multiple legs 96 may provide additional structural support to the support brace assembly 59 by spreading out the forces applied against the upright support member 14 during game play.

When the upright support member 14 is disposed in the extended or deployed position, the sleeve 84 is substantially co-linear with the stand 86. However, because the sleeve 84 and the stand 86 are pivotally joined to the upright support member 14, the support base 12 and to each other, a locking device 98 may be provided to maintain the upright support member 14 in the extended or deployed position. The sleeve 84 and stand 86 may be reconfigured to allow at least a portion of the upright support member 14 to nest within the recess 64 formed in the upper surface 66 of the base 12.

In addition to the foregoing, a selectively engageable locking device 98 may be desirable to allow for repeated setup and take down of the basketball goal system 10. Such a selectively engageable locking device 98 may comprise a spring biased pin 100 disposed in the sleeve 84 and a receiving opening 102 disposed in the stand 86. In other variations, selectively engageable locking mechanisms may include bolts, pins, latches and the like. The locking device 98 may also be a permanent locking mechanism such that once the upright support member 14 is disposed in the extended or deployed position, the support brace assembly 59 is permanently locked in position.

As illustrated in FIG. 2, a support frame 116 may be provided as part of the backboard 20. The support frame 116 may be constructed from a suitable rigid material such as square metal tubing that may be secured around the perimeter of the backboard 20 with metal supports 117 positioned within the interior of the support frame 116. The backboard 20 may also be constructed from molded polymers or fiberglass. In such a configuration, the support frame 116 may be molded as an integral part of the backboard 20. In other variations, sheet metal may be cut and bent to form a support frame 116 sufficient for supportably engaging the backboard 20. In still another variation, the support frame 116 may be integrally formed as part of a blow molding process. Structurally, the support frame 116 provides added support to the basketball goal support structure 16 and ensures that the backboard 20 will be able to withstand the stresses of normal game play.

One or more biasing members or counterbalancing mechanisms may be attached to the basketball goal system 10 in a variety of ways to minimize the force required to adjust the height of the basketball goal. These ways may include, but are not limited to, attaching one end of a biasing member to the upright support member 14 and the other opposing end to the basketball goal support structure 16 or the extension arm 44. A biasing member may also be a piston or other mechanical counterbalancing member or mechanism that provides a force acting in the opposite direction of the force acting on the basketball goal support structure 16 due to the weight of the basketball goal 26. The use of a counterbalancing member minimizes the force required to adjust the height of the basketball goal 26 above the playing surface.

Figure 3:
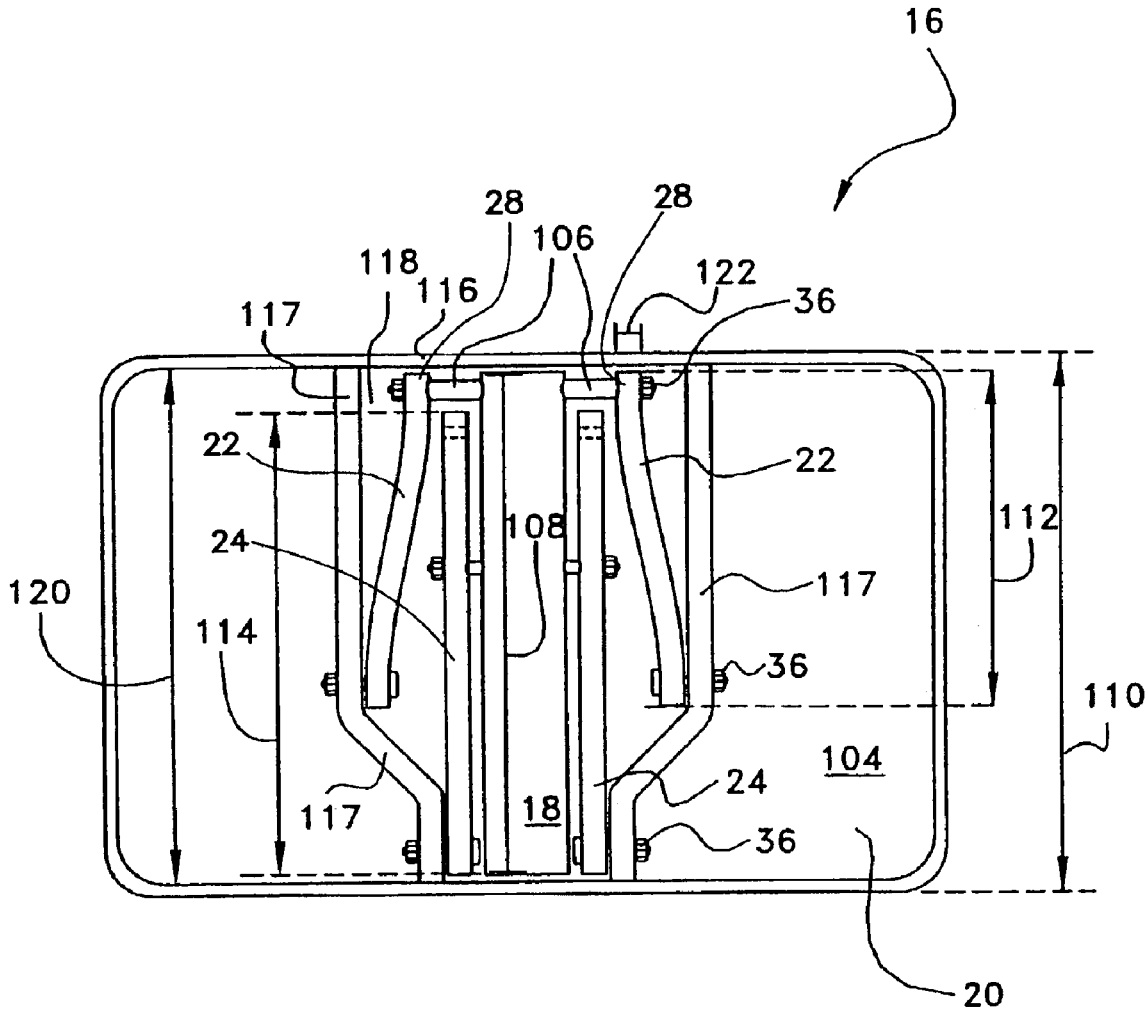
FIG. 3 is a back plan view of the basketball goal support structure of FIG. 1 shown in a collapsed position.

Referring now to FIG. 3, the pair of first support arms 22 is preferably positioned outside of the second pair of support arms 24 to provide clearance for the second support arms 24 and fasteners 36 when the goal support structure 16 is nested in relation to the back section of the backboard 20 when disposed in the collapsed position. The support frame 116 and the first and second support arms 22, 24 may be configured such that the second support arms 24 may be positioned outside the first support arms 22.

The support frame 116 may be attached to the support arms 22, 24 of the goal support structure 16 to facilitate nesting of the attachment member 18 against the backboard 20. Spacers 106 may be positioned along the length of the fasteners 36 which secure the first end 28 of the first support arms 22 to the attachment member 18, thus creating a space between the support arms 22 and the attachment member 18 to facilitate nesting of the second support arms 24. The first support arms 22 are preferably bent in a slight "s" configuration to position the first ends 28 of each of the first support arms 22 away from the attachment member 18, which also provides more space for the second support arms 24 to nest.

The frame supports 117 are bent, thereby permitting the first end of the first support arms 22 to connect to the frame support 117 at a point further away than the attachment of the second support arms 24. In other variations, a combination of spacers and bending may be used to provide the required clearances necessary to sufficiently nest the goal support structure 16 in the collapsed position relative to the backboard 20. The first and second support arms 22, 24 may be attached at a variety of locations along the length of the frame 116 or backboard 20.

Because sufficient clearance is provided for both the pair of first support arms 22 and the pair of second support arms 24 between the attachment member 18 and the frame supports 117, the support arms 22, 24 may be disposed against the back surface 104 of the backboard 20 without overlapping each other. This compact configuration allows the goal support structure 16 to be efficiently packaged and stored in an assembled state.

Additional compactness of the preassembled goal support structure 16 may be achieved by configuring the goal support structure 16 to not extend beyond a perimeter of the backboard 20 in the collapsed position. This may be accomplished by selecting the length 108 of the attachment member 18 to be less than or equal to the width 110 of the backboard 20. Likewise, the length 112 of the first support arms 22 and the length 114 of the second support arms 24 may be selected to be less than or equal to the width 110 of the backboard 20. Thus, the working components of the preassembled basketball goal support structure 16 may be contained within the perimeter of the support frame 116 of the backboard 20.

The goal support structure 16 may be completely collapsed within the confines of a cavity 118 defined by the support frame 116 so that the attachment member 18 and the first and second support arms 22, 24 may substantially lie or nest against the back surface 104 of the backboard 20. This configuration allows for compactness of the preassembled goal support structure 16 and allows the goal support structure 16 to be packaged and/or stored in a preassembled, compact state. As best illustrated in FIG. 3, the length of the attachment member 18 and the length of the first and second support arms 22, 24 are established to fit within an internal cavity 118 defined by the support frame 116 attached to the perimeter of the backboard 20.

To create a substantially flat and compact basketball goal support structure 16 when disposed in the collapsed position, the support frame 116 may be configured to extend outwardly from the back surface 104 of the backboard 20 defining the internal cavity 118, wherein various components of the goal support structure 16 may be retained for storage or shipping. The internal cavity 118 is preferably defined by the perimeter of the support frame 116 and the back surface 104 of the backboard 20. Thus, the internal cavity 118 is open on at least one side to provide for the introduction of the foldable components of the goal support structure 16.

The height or depth of the internal cavity 118 may be configured to permit the selective introduction of the first and second support arms 22, 24 and the attachment member 18 within the confines of the internal cavity 118 when the goal support structure 16 is selectively disposed in the collapsed position. A portion of the attachment member 18 and/or the first and/or second support arms 22, 24 may extend outwardly beyond the confines of the internal cavity 118 depending on the size and shape of the various component pieces of the basketball goal support structure 16. Thus, any portion of a collapsible basketball goal support structure 16 including an attachment member 18, one or more first support arms 22 and/or one or more second support arms 24, may selectively nest in relation to a backboard 20 in a preassembled state.

As shown in FIGS. 1–4, a backboard 20 desirably forms part of the basketball goal system 10. The backboard 20 is preferably constructed from a lightweight material, such as plastic. Desirably, the backboard 20 is constructed from blow-molded plastic to create a strong, lightweight and durable backboard. In greater detail, the backboard 20 is preferably constructed using a blow-molded plastic process, and the backboard includes two opposing walls or surfaces that are separated by a given distance in order to create a strong and sturdy structure. In addition, the interior portion of the blow-molded backboard 20 is preferably generally hollow. Advantageously, this creates a backboard 20 that is lightweight, strong and rigid, which allows the backboard to withstand repeated impacts with a basketball or other similar objects.

The backboard 20 is preferably constructed from blow-molded plastic because it can easily be formed into any desired size and configuration. The backboard 20 is also desirably constructed from blow-molded plastic because it is durable, weather resistant from blow-molded plastic generally does not corrode, rust or otherwise deteriorate over time.

The backboard 20 is preferably constructed from lightweight, blow-molded plastic because weight reduction of the basketball goal system 10 is highly desirable. For example, many home basketball systems are marketed directly to consumers in retail stores. Thus, the purchaser may be required to bring the basketball system to a register to be purchased, load the system in a vehicle, and assemble the system at home. If the backboard 20 is heavy, then the weight of the basketball goal system 10 and the overall weight of the entire basketball system is increased. A consumer may be reluctant to purchase and assemble a basketball system that is too heavy.

Advantageously, constructing the backboard 20 from lightweight, blow-molded plastic decreases shipping costs, whether shipping the system from the manufacturer to a retailer or consumer. In addition, the lightweight backboard 20 simplifies the assembly of the basketball goal system 10 because the lighter weight backboard is easier to manipulate and control during the assembly process. Advantageously, because the backboard 20 is lightweight, the support pole 14 and/or other support structures do not have to support a heavy backboard. This allows the support pole 14 and support structure 16 to be constructed from lighter weight materials.

The backboard 20 may be constructed entirely from blow-molded plastic or it may include one or more openings that are covered by a rebound member such as an acrylic sheet. The rebound member may be attached to the backboard 20 in various suitable ways including those disclosed in Assignee's copending U.S. patent application Ser. No. 09/228,325, entitled System and Method for Bonding an Acrylic Surface to a Frame, filed on Jan. 11, 1999, which is hereby incorporated by reference in its entirety.

Figure 4:
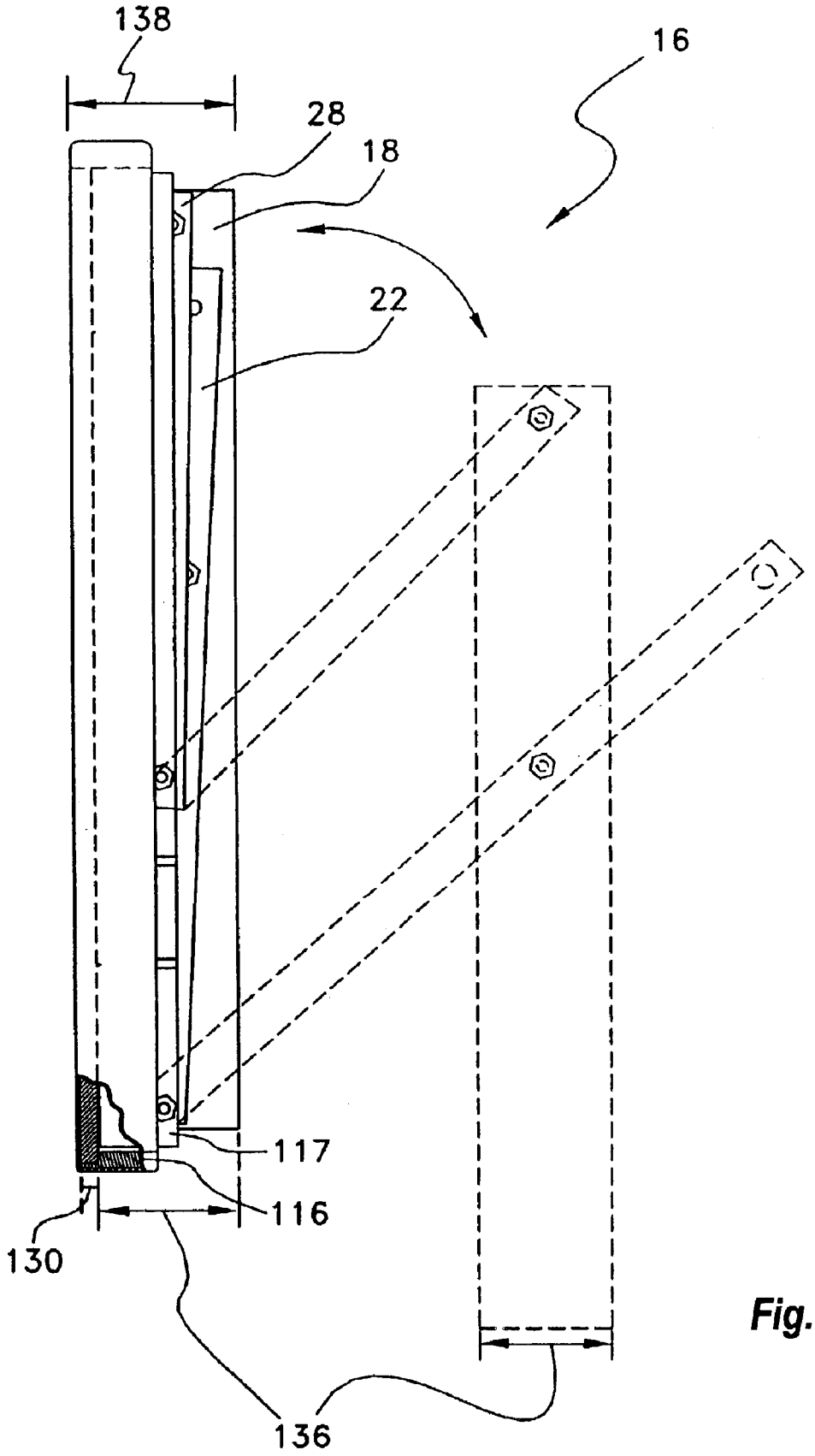
FIG. 4 is a side plan view of the basketball goal support structure of FIG. 1 illustrating the goal support structure disposed in the partially collapsed position and in the extended position which is shown in phantom.

Referring now to FIG. 4, the attachment member 18 and the support arms 22, 24 are configured to lie substantially in the same plane as the backboard 20 when the goal support structure 16 is selectively disposed in the collapsed position. The cross sectional thickness 136 of the attachment member 18 plus the thickness 130 of the backboard 20 are substantially equal to the thickness 138 of the basketball goal support structure 16 when disposed in the collapsed position. As best illustrated in FIG. 3, with the first support arms 22 and the second support arms 24 positioned in substantially the same plane as the attachment member 18, the first and second support arms 22, 24 nest substantially flush against the backboard 20 alongside the attachment member 18. Thus, the basketball goal support structure 16 is capable of compact storage, packaging and shipping in a preassembled state.

The present invention also relates to a method of packaging a preassembled basketball goal support structure 16 in a relatively compact, flat container such as a cardboard box. One method includes the steps of selectively positioning a basketball goal support structure 16 in a collapsed position such that the first support arm(s) 22, the second support arm(s) 24 and an attachment member 18 are substantially nested within the internal periphery of an internal cavity 118 and against a surface 104 of a backboard 20. In this position, the basketball goal support structure 16 may be introduced into a relatively flat container for shipping or storage.

In another variation, the attachment member 18 is configured to lie within all or a portion of the internal periphery of the backboard 20 when the goal support structure is disposed in the collapsed position. The step of positioning the goal support structure 16 in the collapsed position includes the step of positioning at least a portion of the attachment member 18 within the internal periphery of the backboard 20. Moreover, the step of positioning the basketball goal support structure 16 in the collapsed position may also include the steps of selectively positioning at least a portion of the first support arm 22 and/or the second support arm 24 within the internal periphery of the backboard 20. Similarly, the step of positioning the attachment member 18 and the first and second support arms 22 may include positioning them in substantially the same plane as the backboard 20.

The step of inserting of the preassembled basketball goal support structure 16 into a container may be accomplished manually or by some mechanical means. In order to protect and secure the components of the basketball goal support structure 16 within the container, packaging material such as shrink wrap, cardboard, bubble wrap, foam pellets, molded foam, shredded paper and/or the like may be used.

In another variation, the various components of the basketball goal support structure are configured to be selectively positionable within a perimeter of the backboard when the goal support structure is disposed in the collapsed position. Thus, a preferred method of packaging the basketball goal support structure may include the steps of positioning the goal support structure within the penmeter: of the backboard and introducing the collapsed, compact goal support structure within a packaging container for shipping or storage.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

What is claimed is:

1. A deformable basketball goal support structure configured to selectively engage a rigid upright member and allow for adjustment of the height of a basketball goal above a playing surface, the basketball goal support structure comprising:

an attachment member configured to connect the goal support structure to the upright member, the attachment member including an upper end and a lower end, the lower end being configured to connect the goal support structure to the upright member;

a backboard having an internal periphery disposed within a rear portion of the backboard, the backboard including an upper portion and a lower portion; and at least one support arm pivotally attached between the attachment member and the backboard, the attachment member and the at least one support arm forming at least a portion of a deformable structure that is movable between an extended position for game play and a collapsed position, at least a majority of the attachment member and the at least one support arm being positioned within the internal periphery of the backboard when the deformable structure is in the collapsed position to facilitate packaging of the basketball goal support structure;

wherein the upper end of the attachment member is disposed proximate the upper portion of the backboard and the lower end of the attachment member is disposed proximate the lower portion of the backboard when the deformable structure is in the collapsed position; and wherein the upper end of the attachment member is spaced apart from the backboard and the lower end of the attachment member is spaced apart from the backboard when the deformable structure is in the extended position.

2. The basketball goal support structure as in claim 1, wherein the attachment member has a length that is less than a distance between the upper portion of the backboard and the lower portion of the backboard.

3. The basketball goal support structure as in claim 1, wherein the attachment member is at least substantially disposed within the internal periphery of the backboard when the deformable structure is in the collapsed position.

4. The basketball goal support structure as in claim 1, wherein at least a portion of the attachment member is configured to lie substantially flat against the backboard when the deformable structure is disposed in the collapsed position.

5. The basketball goal support structure as in claim 1, wherein the at least one support arm is at least substantially disposed within the internal periphery of the backboard when the deformable structure is disposed in the collapsed position.

6. The basketball goal support structure as in claim 1, wherein at least a portion of the at least one support arm is configured to lie substantially flat against the backboard when the deformable structure is disposed in the collapsed position.

7. The basketball goal support structure as in claim 1, wherein the at least one support arm comprises a first support arm and a second support arm that are pivotally attached between the attachment member and the backboard.

8. The basketball goal support structure as in claim 7, wherein at least a portion of the second support arm is at least substantially disposed within the internal periphery of the backboard when the deformable structure is disposed in the collapsed position.

9. The basketball goal support structure as in claim 7, wherein the second support arm is at least substantially disposed within the internal periphery of the backboard when the deformable structure is disposed in the collapsed position.

10. The basketball goal support structure as in claim 1, wherein the backboard is constructed from blow molded plastic.

11. The basketball goal support structure as in claim 10, further comprising a frame that is integrally formed in the backboard as part of the blow molding process.

12. The basketball goal support structure as in claim 1, wherein the attachment member and the at least one support arm are configured to rest in substantially the same plane when the deformable structure is disposed in the collapsed position.

13. The basketball goal support structure as in claim 1, wherein the at least one support arm and the attachment member are at least substantially disposed within the internal periphery when the deformable support is in the collapsed position.

14. The basketball goal support structure as in claim 1, wherein the backboard includes a support frame.

15. The basketball goal support structure as in claim 14, wherein the at least one support arm comprises a pair of first support arms and a pair of second support arms, each of the support arms pivotally attached between the attachment member and the support frame of the backboard.

16. The basketball goal support structure as in claim 15, wherein the pair of first support arms are spaced apart and substantially parallel to the pair of second support arms when the deformable basketball goal support structure is in the extended position for game play; and wherein the pair of first support arms, the pair of second support arms, the backboard and the attachment member have a generally parallelogram configuration when the deformable basketball goal support structure is in the extended position for game play.

17. The basketball goal support structure as claim 16, wherein the backboard is constructed from blow molded plastic.

18. The basketball goal support structure as claim 17, wherein the backboard includes a frame that is integrally formed in the backboard as part of a one-piece structure during the blow molding process.

19. A deformable basketball goal support structure configured to selectively engage a rigid upright member and allow for adjustment of the height of a basketball goal above a playing surface, the basketball goal support structure comprising:

an attachment member configured to connect the goal support structure to the upright member, the attachment member including an upper end and a lower end, the lower end being configured to connect the goal support structure to the upright member;

a backboard having a support frame defining an internal periphery, the backboard including an upper portion and a lower portion;

a first support arm pivotally secured between the attachment member and the backboard; and a second support arm pivotally secured between the attachment member and the backboard, the attachment member and the first and second support arms forming a deformable structure movable between an extended position for game play and a collapsed position, the attachment member, the backboard, the first support arm and the second support arm having a generally parallelogram configuration when the deformable structure is in the extended position for game play, at least a portion of the attachment member and the first and second support arms being positioned within the internal periphery of the support frame of the backboard when the deformable structure is disposed in the collapsed position to facilitate packaging of the basketball goal support structure;

wherein the upper end of the attachment member is disposed proximate the upper portion of the backboard and the lower end of the attachment member is disposed proximate the lower portion of the backboard when the deformable structure is in the collapsed position; and wherein the upper end of the attachment member is spaced apart from the backboard and the lower end of the attachment member is spaced apart from the backboard when the deformable structure is in the extended position.

20. The basketball goal support structure as in claim 19, wherein the attachment member has a length that is less than a distance between the upper portion of the backboard and the lower portion of the backboard.

21. The basketball goal support structure as in claim 19, wherein the attachment member is disposed within the internal periphery of the support frame of the backboard when the deformable structure is disposed in the collapsed position.

22. The basketball goal support structure as in claim 19, wherein at least a portion of the attachment member is configured to lie substantially flat against the backboard when the deformable structure is disposed in the collapsed position.

23. The basketball goal support structure as in claim 19, wherein the first support arm is disposed within the internal periphery of the support frame of the backboard when the deformable structure is disposed in the collapsed position.

24. The basketball goal support structure as in claim 19, wherein at least a portion of the first support arm is configured to lie substantially flat against the backboard when the deformable structure is disposed in the collapsed position.

25. The basketball goal support structure as in claim 19, wherein at least a portion of the second support arm is disposed within the internal periphery of the support frame of the backboard when the deformable structure is disposed in the collapsed position.

26. The basketball goal support structure as in claim 19, wherein the second support arm is disposed within the internal periphery of the support frame of the backboard when the deformable structure is disposed in the collapsed position.

27. The basketball goal support structure as in claim 19, wherein the attachment member and the support arms are configured to rest in substantially the same plane when the deformable structure is disposed in the collapsed position.

28. The basketball goal support structure as in claim 19, wherein the backboard is constructed from blow molded plastic.

29. The basketball goal support structure as in claim 28, wherein the frame is integrally formed in the backboard as part of a one-piece structure during the blow molding process.

30. The basketball goal support structure as in claim 19, wherein the first support arm, the second support arm and the attachment member are disposed within the internal periphery when deformable structure is disposed in the collapsed position.

31. The basketball goal support structure as in claim 19, wherein the first support arm includes a pair of first support arms and the second support arm includes a pair of second support arms, each of the support arms pivotedly attached between the attachment member and the support frame of the backboard.

32. The basketball goal support structure as in claim 31, wherein the pair of first support arms are spaced apart and substantially parallel to the pair of second support arms when the deformable structure is disposed in the extended position.

33. The basketball goal support structure as in claim 32, wherein the backboard is constructed from blow molded plastic.

34. The basketball goal support structure as in claim 33, wherein the backboard includes a frame that is integrally formed in the backboard as part of a one-piece structure during the blow molding process.

35. A basketball goal system that is movable between a use position that facilitates playing the game of basketball and a collapsed position that facilitates packaging of the basketball goal system, the basketball goal system comprising:

a backboard including a front face and a rear face, the backboard having a maximum height measured from a lower portion to an upper portion;

a basketball goal disposed proximate the front face of the backboard;

a pair of first support arms, each of the pair of first support arms having a length;

a pair of second support arms, each of the pair of second support arms having a length; and a support member having a length measured from a lower end to an upper end, the pair of first support arms and the pair of second support at least partially interconnecting the backboard and the support member, the pair of first support arms, the pair of second support arms, the backboard and the support member having a generally parallelogram configuration when the basketball goal system is in the use position;

wherein the length of the support member, the length of the first support arms and the length of the second support arms are generally equal to or less than the maximum height of the backboard;

wherein the support member, the pair of first support arms and the pair of second support arms are generally positioned adjacent to the rear face of the backboard when the basketball goal system is in the collapsed position;

wherein the upper end of the attachment member is disposed proximate the upper portion of the backboard and the lower end of the attachment member is disposed proximate the lower portion of the backboard when the deformable structure is in the collapsed position; and wherein the upper end of the attachment member is spaced apart from the backboard and the lower end of the attachment member is spaced apart from the backboard when the deformable structure is in the extended position.

36. The basketball goal system as in claim 35, wherein the backboard is constructed from blow-molded plastic.

37. The basketball goal system as in claim 35, further comprising a rearwardly extending portion extending from the rear surface of the backboard, the pair of first support arms, the pair of second support arms and the support member being generally disposed within the rearwardly extending portion when the basketball goal system is in the collapsed position.

38. The basketball goal system as in claim 37, wherein the rearwardly extending portion is a lip disposed about the perimeter of the backboard.

39. The basketball goal system as in claim 37, wherein the rearwardly extending portion extends completely around the perimeter of the backboard.

40. The basketball goal system as in claim 37, wherein the backboard is constructed from blow-molded plastic and the rearwardly extending portion is a lip that is integrally formed with the backboard to form a unitary, one-piece structure.

41. The basketball goal system as in claim 37, wherein the rearwardly extending portion is a frame that is attached to the rear surface of the backboard.

42. The basketball goal system as in claim 37, wherein the rearwardly extending portion has a length that is generally equal to or larger than a width of the pair of first support arms, the pair of second support arms or the support member.

43. The basketball goal system as in claim 37, wherein the rearwardly extending portion and the rear surface of the backboard generally form an envelope; and wherein the pair of first support arms, the pair of second support arms and the support member are generally disposed within the envelope when the basketball goal system is in the collapsed position.

44. The basketball goal system as in claim 37, wherein the pair of first support arms, the pair of second support arms and the support member are generally aligned in the same plane when the basketball goal system is in the collapsed position.

45. The basketball goal system as in claim 37, further comprising a plane generally aligned with an outer surface of the rearwardly extending portion; and wherein the pair of first support arms, the pair of second support arms and the elongated member are generally disposed between the rear face of the backboard and the plane generally aligned with the outer surface of the rearwardly extending portion.

46. The basketball goal system as in claim 37, wherein the pair of first support arms, the pair of second support arms and the elongated member are generally aligned in the same plane and positioned within a boundary generally defined by an outer perimeter of the backboard when the basketball goal system is in the collapsed position.

47. The basketball goal system as in claim 35, further comprising a height adjustment mechanism that is sized and configured to allow the height of the basketball goal system to be adjusted.

48. The basketball goal system as in claim 35, further comprising a support pole with a first end and a second end, the first end being attached to the elongated member to support the backboard and basketball goal above a playing surface.

49. The basketball goal system as in claim 48, further comprising a base attached to the second end of the support pole, the base including a generally hollow interior portion that is sized and configured to be filled with a ballast material.

50. The basketball goal system as in claim 49, wherein the base includes a recess that is sized and configured to receive at least a portion of the support pole when the basketball goal system is in the collapsed position.

* * * * *

UNITED STATES PATENT AND TRADEMARK OFFICE

CERTIFICATE OF CORRECTION

PATENT NO. : 6,932,725 B2
DATED : August 23, 2005
INVENTOR(S) : Charles Monsen

It is certified that error appears in the above-identified patent and that said Letters Patent is hereby corrected as shown below:

Column 14,
Line 3, after "weather resistant" insert:
-- and generally temperature insensitive. Advantageously, the backboard 20 constructed --.

Column 15,
Line 15, before "the preassembled" remove "of".
Line 28, change "penmeter:" to -- perimeter --.

Column 17,
Line 15, before "claim 16," insert -- in --.
Line 16, before "claim 17," insert -- in --.

Column 19,
Line 12, after "second support" insert -- arms --.

Signed and Sealed this

Twenty-first Day of February, 2006

JON W. DUDAS
*Director of the United States Patent and Trademark Office*